US009556781B2

(12) United States Patent
Ludeman et al.

(10) Patent No.: US 9,556,781 B2
(45) Date of Patent: Jan. 31, 2017

(54) EXHAUST GAS AFTERTREATMENT MODULE

(71) Applicant: Caterpillar Inc., Peoria, IL (US)

(72) Inventors: Jacob K. Ludeman, Mapleton, IL (US); Brian J. DeCaires, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 59 days.

(21) Appl. No.: 14/624,013

(22) Filed: Feb. 17, 2015

(65) Prior Publication Data

US 2015/0159537 A1 Jun. 11, 2015

Related U.S. Application Data

(63) Continuation of application No. 13/727,203, filed on Dec. 26, 2012, now Pat. No. 8,978,369.

(51) Int. Cl.

| | |
|---|---|
| ***F01N 13/08*** | (2010.01) |
| ***F01N 13/00*** | (2010.01) |
| ***F01N 3/28*** | (2006.01) |
| ***F01N 3/10*** | (2006.01) |
| ***F01N 13/04*** | (2010.01) |
| *F01N 13/18* | (2010.01) |
| *F01N 13/10* | (2010.01) |

(52) U.S. Cl.

CPC ..... *F01N 13/017* (2014.06); *F01N 3/106* (2013.01); *F01N 3/28* (2013.01); *F01N 3/2885* (2013.01); *F01N 13/0097* (2014.06); *F01N 13/011* (2014.06); *F01N 13/04* (2013.01); *F01N 13/08* (2013.01); *F01N 3/2842* (2013.01); *F01N 13/007* (2013.01); *F01N 13/0093* (2014.06); *F01N 13/107* (2013.01); *F01N 13/18* (2013.01); *F01N 2230/06* (2013.01); *F01N 2340/04* (2013.01); *F01N 2350/02* (2013.01); *F01N 2470/22* (2013.01); *F01N 2490/14* (2013.01); *F01N 2590/08* (2013.01); *F01N 2590/10* (2013.01); *Y10T 29/49345* (2015.01)

(58) Field of Classification Search

CPC ..... F01N 3/10; F01N 3/103; F01N 3/2842; F01N 13/007; F01N 13/0093; F01N 13/0097; F01N 13/18; F01N 2350/02; F01N 2470/22; F01N 2490/14; F01N 2590/08

USPC ..... 60/274, 295, 296, 299, 324

See application file for complete search history.

(56) References Cited

U.S. PATENT DOCUMENTS

| | | | | |
|---|---|---|---|---|
| 2,898,202 | A | 8/1959 | Houdry et al. | |
| 4,690,245 | A * | 9/1987 | Gregorich | F01N 1/003 138/40 |

(Continued)

*Primary Examiner* — Jorge Leon, Jr.

(74) *Attorney, Agent, or Firm* — Leydig, Voit & Mayer, Ltd.

(57) ABSTRACT

An aftertreatment module for the treatment of exhaust gasses from a power system includes a first aftertreatment brick and a second aftertreatment brick. The first and second aftertreatment bricks can be flow-through type catalysts for catalyzing byproducts in the exhaust gasses. The aftertreatment module can include a first channel directing the incoming exhaust gasses in a first direction through the first aftertreatment brick and a second channel directing the exhaust gasses through the second aftertreatment brick. The first and second channel can be in a side-by-side arrangement. To communicate the exhaust gasses between the first and second channels, a traverse channel can redirect the gas flow within the aftertreatment module.

15 Claims, 6 Drawing Sheets

(56) References Cited

U.S. PATENT DOCUMENTS

| | | | | |
|---|---|---|---|---|
| 5,169,604 | A | 12/1992 | Crothers, Jr. | |
| 6,148,613 | A * | 11/2000 | Klopp | F01N 3/20 137/625.43 |
| 6,382,347 | B1 * | 5/2002 | Gerber | F01N 1/04 181/212 |
| 6,722,124 | B2 * | 4/2004 | Pawson | B01D 53/9431 422/172 |
| 6,824,743 | B1 | 11/2004 | Pawson et al. | |
| 7,430,855 | B2 * | 10/2008 | Amemiya | F01N 1/084 60/286 |
| 7,614,215 | B2 | 11/2009 | Warner et al. | |
| RE42,156 | E * | 2/2011 | Hirota | B01D 53/9454 60/274 |
| 7,919,052 | B2 | 4/2011 | Ahmed | |
| 8,015,802 | B2 | 9/2011 | Nishiyama et al. | |
| 8,062,602 | B2 | 11/2011 | Roe et al. | |
| 2002/0002824 | A1 * | 1/2002 | Hirota | F01N 1/084 60/297 |
| 2004/0050618 | A1 * | 3/2004 | Marocco | F01N 1/02 181/248 |
| 2005/0115229 | A1 | 6/2005 | Worner et al. | |
| 2009/0293462 | A1 | 12/2009 | Duch et al. | |
| 2010/0050618 | A1 * | 3/2010 | Huthwohl | F01N 1/084 60/299 |
| 2011/0126531 | A1 | 6/2011 | Kye et al. | |
| 2011/0146253 | A1 * | 6/2011 | Isada | F01N 3/2073 60/302 |

* cited by examiner

EXHAUST GAS AFTERTREATMENT MODULE

CROSS-REFERENCE TO RELATED APPLICATIONS

This application is a continuation of U.S. application Ser. No. 13/727,203, filed on Dec. 26, 2012.

TECHNICAL FIELD

This patent disclosure relates generally to an aftertreatment system for reducing emissions in exhaust gasses produced by a power source such as a large internal combustion engine and, more particularly, to a reverse-flow system for efficient treatment and packaging.

BACKGROUND

Power systems may include internal combustion engines that burn a hydrocarbon-based fuel to convert the potential or chemical energy stored therein to mechanical power that can be used to power other applications. The applications may be mobile such as vehicles or locomotives, stationary such as power generators, or both. The exhaust gasses that result from combusting fuel in the power system may include byproducts such as carbon oxides (CO and $CO_2$), nitrogen oxides (NO and $NO_2$), and particulate matter. The amount of these byproducts that may be discharged by the power system are often subject to government regulation and emissions laws. Accordingly, manufacturers of power systems have undertaken efforts to reduce or remove the regulated byproducts from the exhaust gasses. One methodology for reducing these byproducts is to employ aftertreatment systems disposed in the exhaust system downstream of the internal combustion engine that can receive the discharged exhaust gasses. For example, the aftertreatment system may include catalytic materials that convert the regulated byproducts to more benign constituents. Other systems might operate by filtering the byproducts out of the exhaust gasses.

Certain considerations may apply to the design of an aftertreatment system such as the effective exposure of the exhaust gasses to the catalytic or filtration materials. Another consideration may be the size and/or shape of the aftertreatment system so that the aftertreatment system is efficiently accommodated in the power system. One example of an aftertreatment system designed to address some of these considerations is described in U.S. Pat. No. 6,824,743 ("the '743 patent"), which describes a cylindrical housing that is closed-off at one end. The housing accommodates an annular filter element disposed around a central return pipe. Exhaust gasses may enter the housing, pass through the annular filter element toward the closed end and return through the central return pipe. The present disclosure is directed to addressing similar efficiency considerations described in the '743 patent.

SUMMARY

In an aspect of the disclosure, there is described an aftertreatment module for treating exhaust gasses. The module includes a housing having a front wall and an opposing rear wall. A first channel extends between the front wall and the rear wall and includes a first aftertreatment brick disposed therein. Similarly, a second channel extends between the rear wall and the front wall and includes a second aftertreatment brick disposed therein. The first channel and the second channel are arranged in parallel with each other. A traverse channel is disposed along the rear wall traversing the first channel and the second channel in order to communicate exhaust gasses between the first channel and the second channel.

In another aspect, the disclosure describes a method of treating exhaust gasses. According to the method, the exhaust gasses are channeled in a first direction and passed through a first aftertreatment brick. The exhaust gasses are redirected and channeled in a second direction where the exhaust gasses are passed through a second aftertreatment brick.

In a further aspect, the disclosure describes a method of assembling an aftertreatment module for treating exhaust gasses. According to the method, a cradle is provided including a first sleeve and a second sleeve disposed in a side-by-side relationship. A first aftertreatment brick is inserted into the first sleeve and a second aftertreatment brick is inserted into the second sleeve. The method provides a module housing including an interior region accessible by a front opening and a rear opening. According to the method, the cradle is inserted through one of the front opening and the rear opening. The front opening is enclosed with a front plate having disposed therein a first port and a second port. The rear opening is also enclosed with a rear plate that may lack ports.

In yet another aspect, the disclosure describes a power system including an internal combustion engine combusting fuel into exhaust gasses to generate a mechanical force. The power system also includes an exhaust system in communication with the internal combustion engine and an aftertreatment module. The aftertreatment module includes a first channel, a second channel parallel and adjacent to the first channel, and a traverse channel communicating between the first channel and the second channel. The exhaust gasses from the internal combustion engine can pass first through a first aftertreatment brick disposed in the first channel and can pass second through a second aftertreatment brick disposed in the second channel.

BRIEF DESCRIPTION OF THE DRAWING(S)

DETAILED DESCRIPTION

Figure 1:
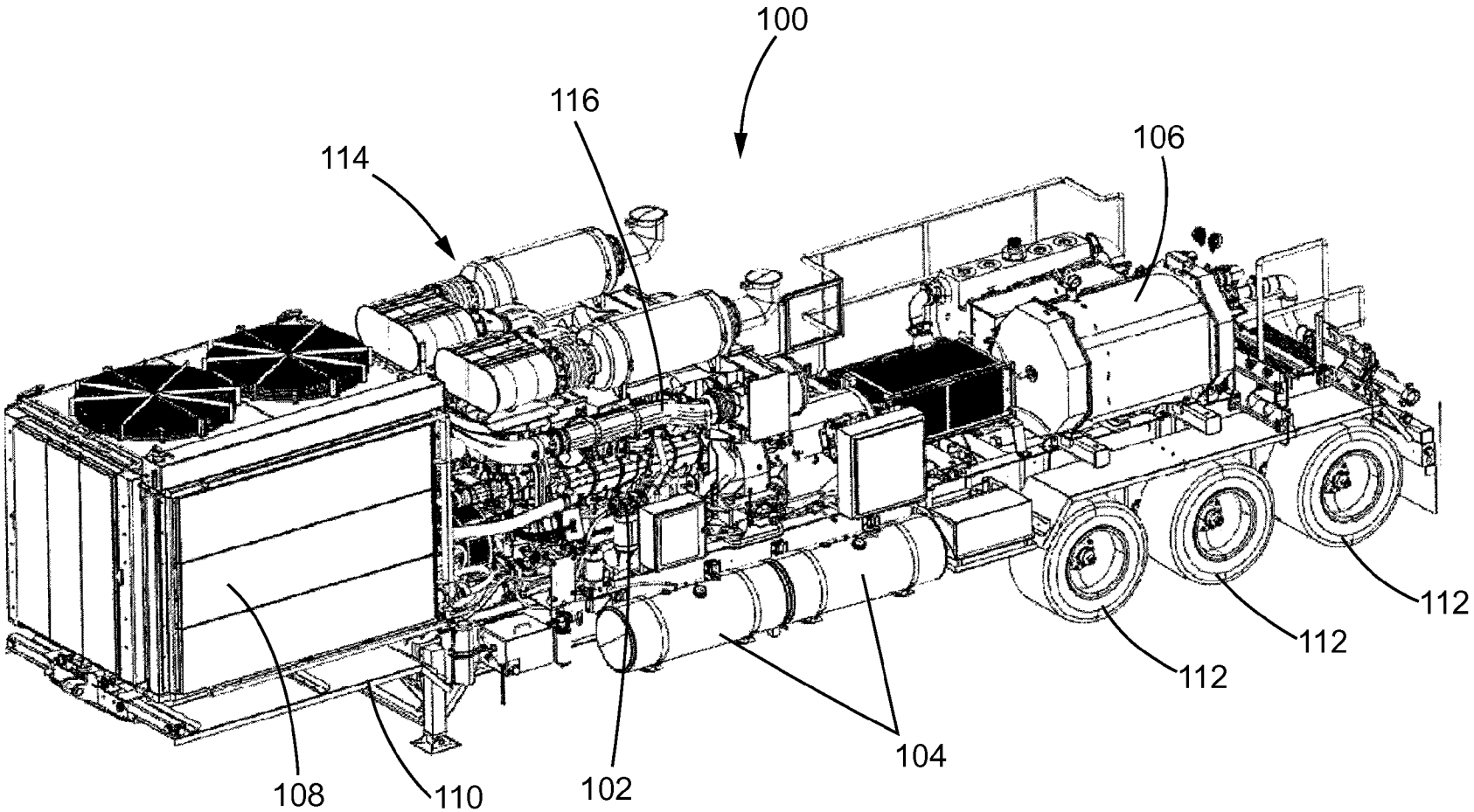
FIG. 1 is a perspective view of a mobile power system and an associated aftertreatment system supported on a trailer for transportation.

This disclosure relates to an aftertreatment system for treating exhaust gasses from a power system before they are released to the atmosphere. Referring to FIG. 1, there is illustrated an example of a power system 100 particularly suited for geological fracturing to recover oil and/or natural gas from the earth. The power system 100 may include an internal combustion engine 102 such as a diesel-burning, compression ignition engine that combusts diesel fuel stored in one or more storage tanks 104. The internal combustion engine is operatively coupled to and can power a hydraulic pump 106 that pumps hydraulic fluid such as water into the ground to fracture rock layers during the fracturing process. To cool the internal combustion engine 102, the power system 100 can include a radiator 108 that circulates coolant to and from the engine to transfer heat generated therein to the environment. Because the fracturing process may require introduction of hydraulic fluids at different locations about the fracturing site, the components of the power system 100 can be supported on a mobile trailer 110 disposed on wheels 112 to enable transportation of the system about the fracturing site.

Due to the large power requirements necessary to run the pump 106 at the required pressures for fracturing, the internal combustion engine can be sized to produce power on the order of 750 horsepower or greater. Accordingly, the internal combustion engine 102 may combust a large volume of fuel and, as a result, may produce a large volume of exhaust gasses. To treat those exhaust gasses, an aftertreatment system 114 is disposed over the internal combustion engine 102 and in fluid communication with the exhaust system 116 of the engine. The term "aftertreatment" refers to the concept that the system treats exhaust gasses after they have been produced and is therefore distinguishable from fuel additives and the like that affect the combustion process. The aftertreatment system 114 can receive the exhaust gasses from a turbocharger in the exhaust system 116 and direct them through one or more aftertreatment modules before release. Although the disclosed embodiment treats exhaust gasses from a diesel-burning internal combustion engine 102, in other embodiments the aftertreatment system 114 can be used with other engines such as a gasoline-burning engine, a natural gas turbine, coal-burning applications and the like. Further, while the particular aftertreatment system 114 is described with respect to a power system 100 used for geological fracturing, in other embodiments, the aftertreatment system and associated power system can be utilized in other applications such as stationary electrical power generation. In addition, the disclosure can be utilized in mobile applications such as locomotives and marine engines.

Figure 2:
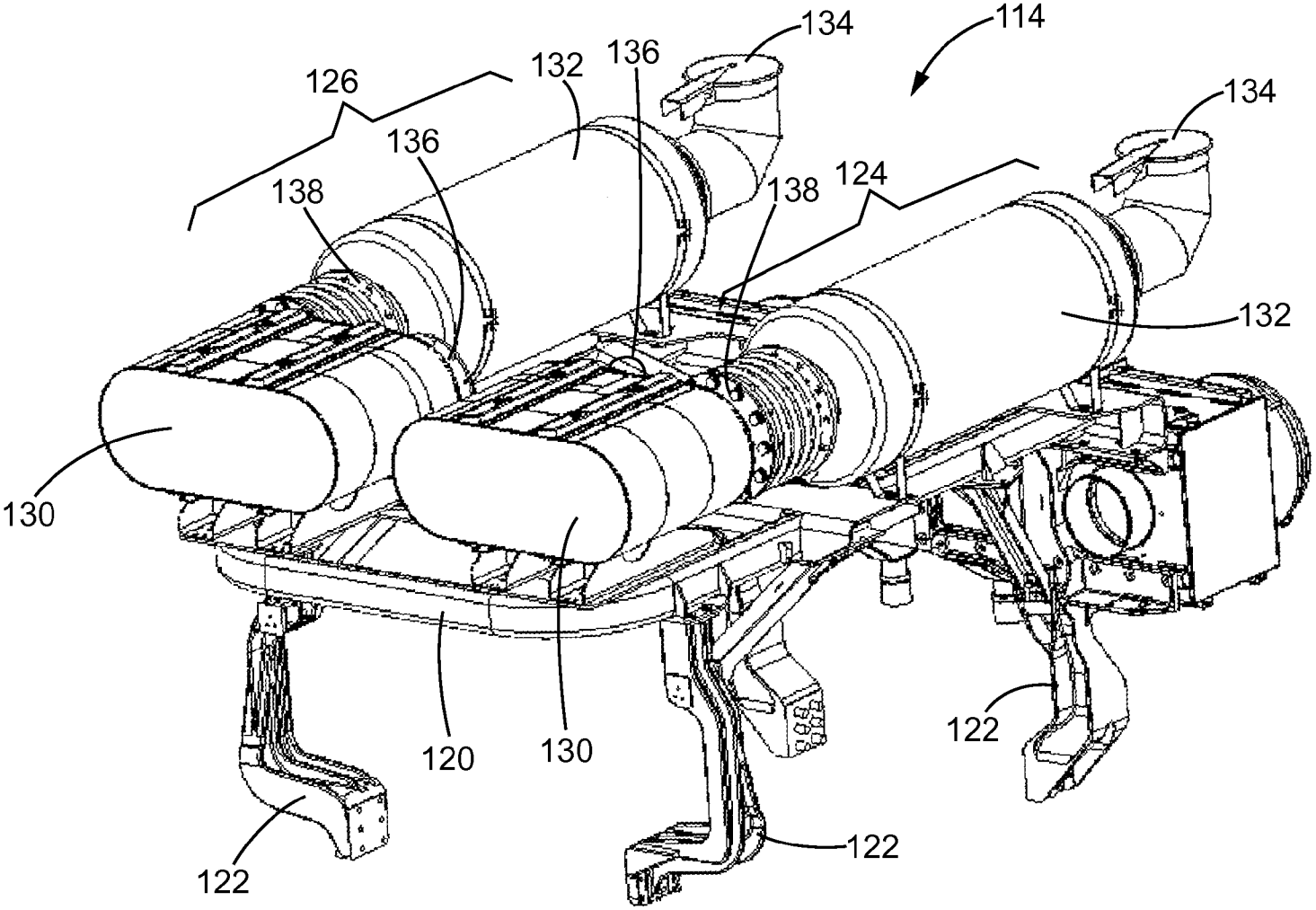
FIG. 2 is a perspective view of the aftertreatment system uncoupled to the power system, the aftertreatment system including an aftertreatment module for treating exhaust gasses.

Referring to FIG. 2, there is illustrated the aftertreatment system 114 including the individual aftertreatment modules or components as removed from the internal combustion engine. Attaching or mounting the aftertreatment system 114 to the engine can be accomplished by a frame 120 having depending legs 122 that can extend around and couple to the engine. In other embodiments, the aftertreatment system may be located at different positions other than directly over the engine, including at remote positions away from the engine. In the illustrated embodiment, the aftertreatment system can include a first exhaust unit 124 and a second exhaust unit 126 arranged in parallel and which generally mirror each other. The first exhaust unit 124 can receive exhaust gasses from one bank of combustion cylinders in the engine while the second exhaust unit can receive exhaust gasses from another, parallel bank of combustion cylinders. Because the first exhaust unit 124 and the second exhaust unit 126 may be generally identical and include the same or similar components, only the first exhaust unit will be described in detail herein.

The first exhaust unit 124 of the aftertreatment system 114 can include an aftertreatment module 130 coupled to a cylindrical, tank-like muffler 132 that terminates in a discharge port 134 where the exhaust gasses may be released to the environment. To couple to and receive the untreated exhaust gasses from the exhaust system of the engine, the aftertreatment module 130 includes or is attached to an inlet flange 136. To couple to and communicate the treated exhaust gasses to the muffler 132, the aftertreatment system also includes an outlet flange 138. The inlet and outlet flanges 136, 138 may be circular and may be coupled to mating flanges on the other components by bolts, welding or other suitable coupling techniques. For reasons described below, the inlet flange 136 and the outlet flange 138 may be generally adjacent to each other and may be oriented in the same direction.

Figure 3:
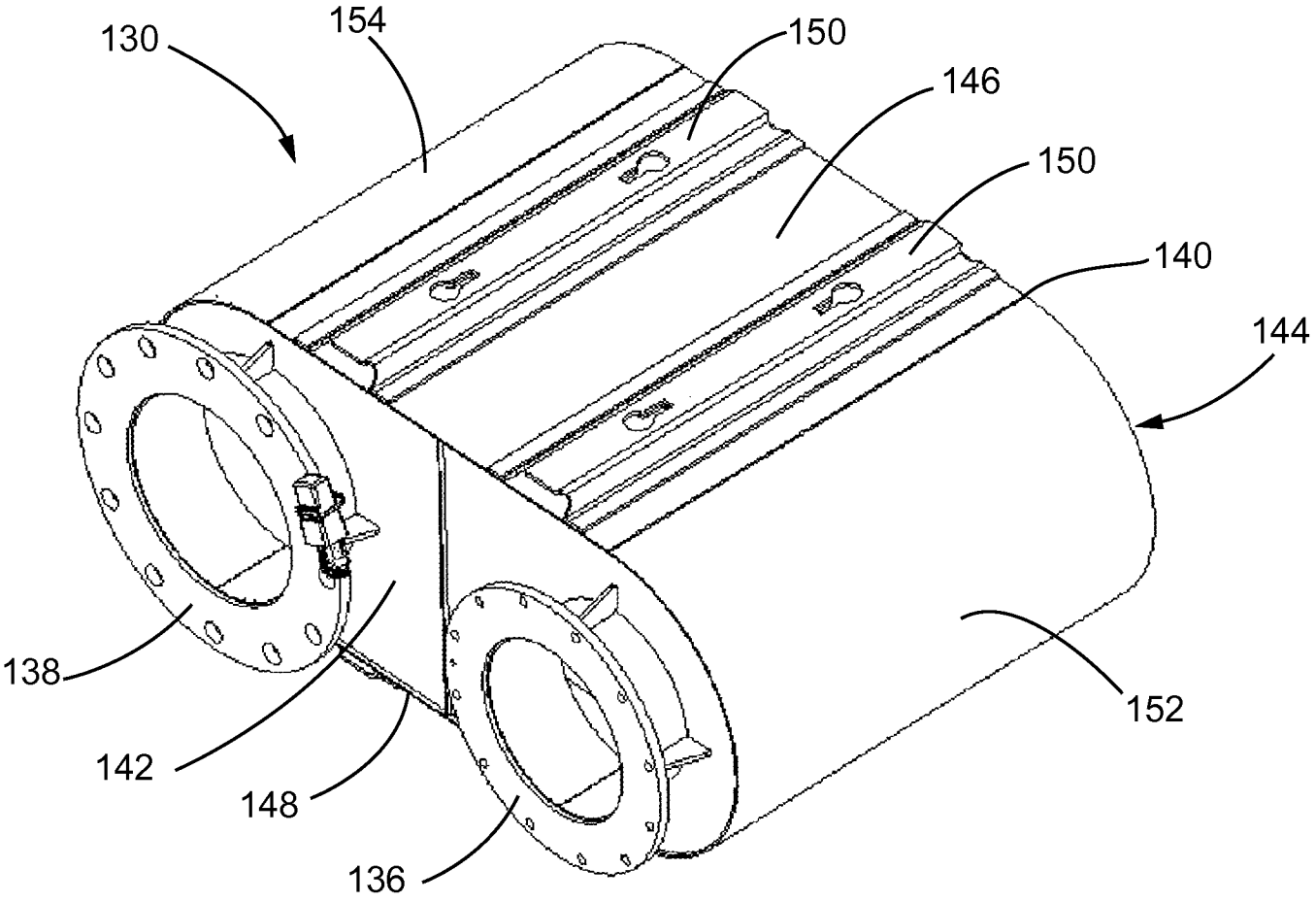
FIG. 3 is a front perspective view of the aftertreatment module having a generally oval-shaped housing with an inlet port and an outlet port disposed through the front wall.

Referring to FIG. 3, to adapt the aftertreatment module 130 for use in what may be mobile applications with specific size and aerodynamic considerations, the aftertreatment module can have a compact, low profile. For example, in the illustrated embodiment, the aftertreatment module 130 may include a housing 140 having a planar plate-like, front wall 142 and an opposing planar, plate-like, rear wall 144. The inlet flange 136 and the outlet flange 138 can be disposed on and protrude from the front wall 142. The rear wall 144 may be solid without any apertures or openings. The front and rear walls 142, 144 may be generally outlined or shaped as ovals with the inlet flange and the outlet flange oriented towards the curved edges of the oval. Furthermore, in FIG. 3, the oval-shaped front and rear walls 142, 144 are oriented horizontally so that the inlet flange 136 and the outlet flange 138 appear in a side-by-side relation. To complete the oval-shaped housing 140, the housing can include a substantially flat top surface 146 extending between the upper lateral edges of the oval-shaped front wall 142 and the corresponding lateral edges of the rear wall 144. A substantially flat bottom surface 148 opposite the top surface can likewise extend between the lateral edges of the front and rear walls 142, 144. To connect the aftertreatment module 130 to the frame of the aftertreatment unit, mounting bracket 150 can be attached to the top surface 146 and/or bottom surface 148. Accordingly, in some embodiments, the after treatment module can be flipped over to re-orientate the inlet and outlet flanges with respect to the aftertreatment unit. So that the housing 140 forms a complete enclosure, the housing can include a first arcuate sidewall 152 that curves between the top and bottom surfaces 146, 148 and a second arcuate sidewall 154 also curving between the top and bottom surfaces. The horizontal arrangement and oval shape of the housing 140 can impart a sense of compactness and a relatively low profile to the aftertreatment module 130. However, it should be understood that terms "front," "rear," "top," "bottom" and the like are used herein merely to provide a point of reference, and are not to be considered to impart specific directional limitations or orientations on the disclosure including the claims unless clearly indicated otherwise.

Figure 4:
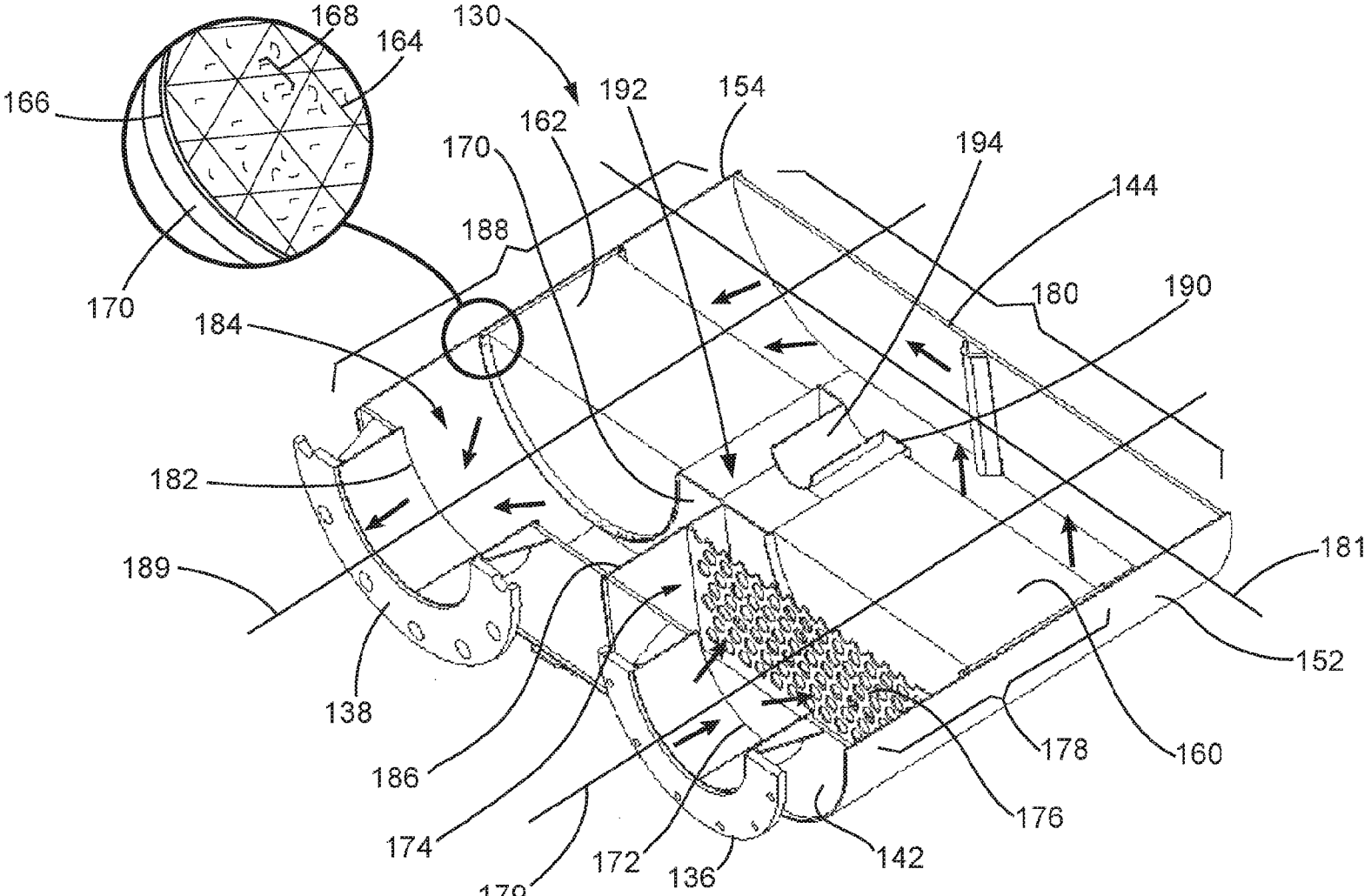
FIG. 4 is a cross-sectional perspective view of the aftertreatment module of FIG. 3 including first and second aftertreatment bricks disposed in the housing and indicating a flow direction of the exhaust gasses through the bricks with a detailed view of the structure of the bricks.

Referring to FIG. 4, the chemical or compositional change to the exhaust gasses during the treatment process can be performed by one or more aftertreatment bricks disposed inside the aftertreatment module 130. Specifically, the aftertreatment module 130 may accommodate a first aftertreatment brick 160, and a second aftertreatment brick 162. In an embodiment, the first and second aftertreatment bricks 160, 162 may be flow-through catalyst bricks that include a material that can chemically react with the byproducts in exhaust gasses. For example, the first and second aftertreatment bricks can be diesel oxidation catalysts (DOCs) that include catalytic materials such as palladium, platinum or other metals from the platinum group. The catalytic materials can react with or catalyze carbon monoxide and hydrocarbons in the exhaust gasses to water and carbon dioxide via the following possible reactions:

$$CO+\tfrac{1}{2}O_2=CO_2 \quad (1)$$

$$[HC]+O_2=CO_2+H_2O \quad (2)$$

To expose the catalytic material to the exhaust gasses, as shown in the detailed view, the first and second aftertreatment bricks can include an internal substrate matrix 164 such as a triangle lattice, honeycomb lattice, metal mesh or similar thin-walled support structure or screen surrounded by and supported inside of a tubular or cylindrical mantel 166. The opened-lattice structure can permit the exhaust gasses to flow through the aftertreatment brick from one side to the other. The catalytic material 168 can be deposited on the substrate matrix 164 by any suitable method including, for example, chemical vapor deposition, adsorption, powder coating, spraying, etc. While the present embodiment utilizes DOCs, different aftertreatment methods can be implemented in other embodiments including the use of selective catalytic reduction (SCR) aftertreatment bricks, diesel particulate filters (DPFs), ammonia oxidation catalysts, and any other suitable aftertreatment system.

To accommodate the aftertreatment bricks 160, 162 in the housing 140, the aftertreatment bricks can be generally cylindrical in shape and can be received in a correspondingly shaped cradle 170. The cradle 170 can be disposed in the housing 140 approximately mid-way between the front wall 142 and the rear wall 144 and can secure the first and second aftertreatment bricks in an adjacent or side-by-side relationship with the first aftertreatment brick oriented toward the first arcuate sidewall 152 and the second aftertreatment brick oriented toward the second arcuate sidewall 154. The first and second flow-through aftertreatment bricks can be oriented in the cradle 170 so that the exhaust gasses can traverse across the cradle.

To receive the exhaust gasses inside the aftertreatment module 130, the inlet flange 136 can define a circular-shaped first port 172 disposed through the front wall 142, which in certain embodiments can function as an inlet port. The first port 172 can access an entry region 174 disposed in the front of the housing 140 between the front wall 142 and the cradle 170. To distribute and decelerate the incoming exhaust gasses and possibly to act as a spark arrester extinguishing any sparks, the entry region 174 can include a perforated diffuser plate 176 or screen. The first port 172, the entry region 174 and the first flow-through catalyst 160 can therefore define a first flow channel 178 extending from the front wall 142 toward the rear wall 144 of the aftertreatment module. As depicted in FIG. 4, the first flow channel 178 extends along and defines a first principal flow axis 179 from the front of the housing 140 through the first aftertreatment brick 160 to the rear of the housing.

To redirect the exhaust gasses to the second aftertreatment brick after passing through the first aftertreatment brick, the housing 140 can include a traverse channel 180 located between the rear wall 144 and the cradle 170. The traverse channel 180 extends along the rear wall 144 from the first arcuate sidewall 152 to the second arcuate sidewall 154. The traverse channel 180 thereby delineates a traverse flow axis 181 that is generally perpendicular to the first flow channel 178 and the first principal flow axis 179. The second aftertreatment brick 162 situated in the cradle 170 proximate the second arcuate sidewall 154 can be exposed to the traverse channel 180 on one side and can access an exit region 184 disposed between the front wall 142 and the cradle on the other side. The exit region 184 and the entry region 174 are thus disposed in an adjacent or side-by-side relationship and can be separated from each other by an internal wall 186 extending between the front wall 142 and the cradle 170.

To direct exhaust gasses out of the exit region 184 and thus the aftertreatment module 130, the outlet flange 138 can define a circular-shaped second port 182 disposed through the front wall 142. The second flow-through aftertreatment brick 162, the exit region 184 and the second port 182 thereby define a second flow channel 188 from the traverse channel 180 to the front wall 142. The first flow channel 178 and the second flow channel 188 are thus arranged in a parallel and adjacent or side-by-side relationship. The second flow channel 188 can further delineate a second principal flow axis 189 that is parallel to the first principal flow axis 179 and perpendicular to the traverse flow axis 181.

In a further embodiment, to reduce or muffle the sound of the internal combustion engine carried by the exhaust gasses, the aftertreatment module 130 can include a sound attenuation device 190. The sound attenuation device 190 can include a hollow, sound attenuation chamber 192 disposed in the cradle 170 generally between the first and second aftertreatment bricks 160, 162 and generally enclosed from the rest of the housing 140. The sound attenuation device can further include a tubular sound attenuation pipe 194 protruding into the sound attenuation chamber 192 from the rear of the cradle 170 and that establishes fluid communication between the chamber and the traverse channel 180. The sound attenuation pipe 194 can have any suitable length or diameter as will be explained in further detail below. In some embodiments, the sound attenuation pipe can be dimensioned to assist in canceling undesirable sounds, for example, in a manner that could assist a muffler. In some other embodiments, the sound attenuation device may just include an orifice establishing communication between the sound attenuation chamber and the traverse channel.

Figure 5:
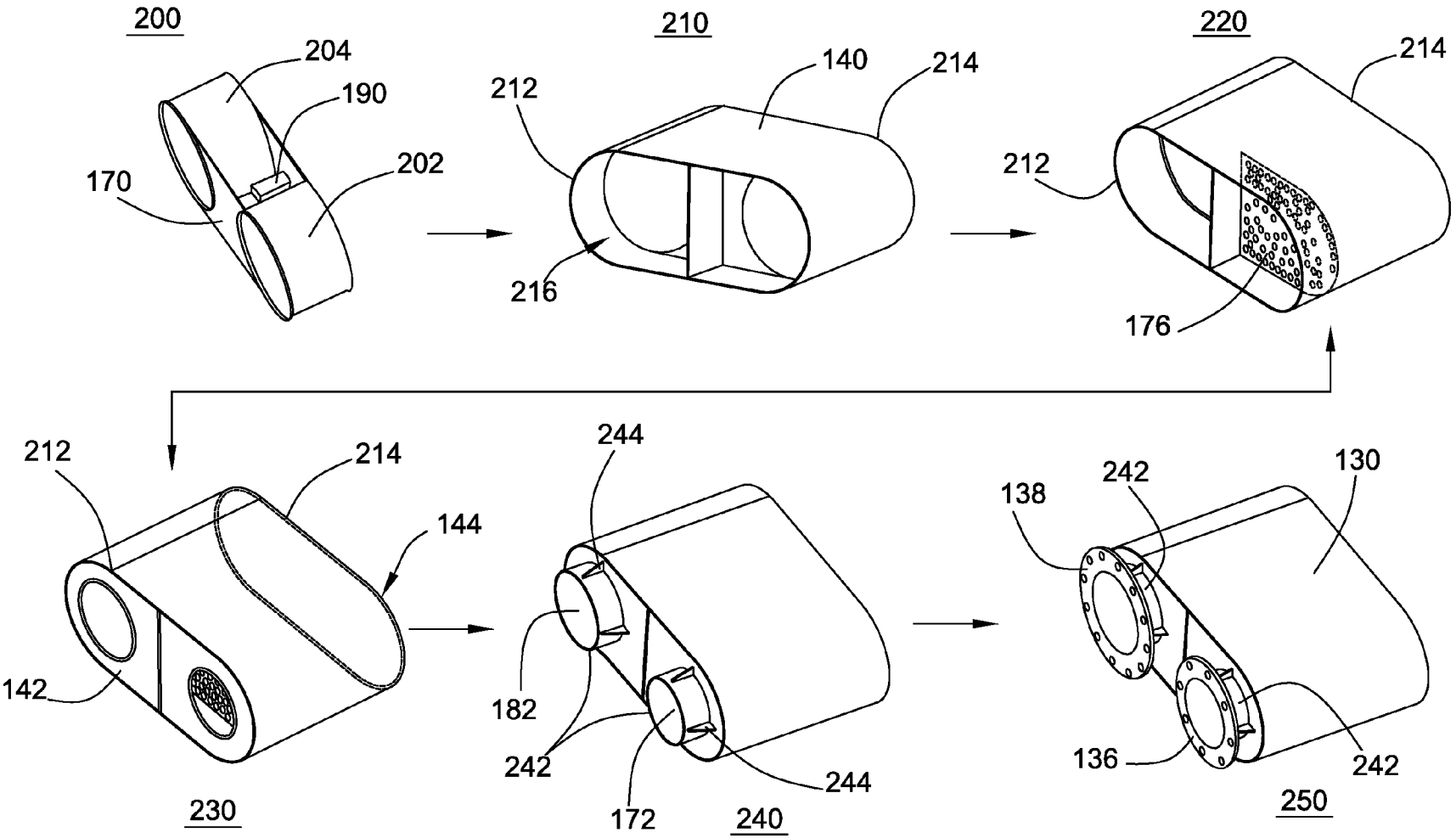
FIG. 5 is a schematic of a process for assembling the embodiment of the aftertreatment module of FIGS. 3 and 4.

To manufacture the aftertreatment module, a multi-step assembly process such as the one illustrated in FIG. 5 can be performed. The order of steps in FIG. 5 may proceed from left to right in the top row, may return and again proceed from left to right in the bottom row. In a first step 200, the cradle 170 is assembled and can include a cylindrical first sleeve 202 and an adjacent cylindrical second sleeve 204 that are sized to accommodate the catalysts. Disposed between the first and second sleeves 202, 204 can be the sound attenuation device 190. The cradle 170 including the first and second sleeves 202, 204 can be made from any suitable material including, for example, rolled sheet steel or aluminum. After the cradle is manufactured, the first and second aftertreatment bricks can be inserted into the respective first and second sleeves 202, 204. In some embodiments, the aftertreatment bricks can be welded to the sleeves while in other embodiments, they may be press fit into the sleeves.

In the second step 210, the housing 140 including the flat top and bottom surfaces and the arcuate first and second sidewalls is manufactured from, for example, sheet steel or aluminum. The front 212 and the rear 214 of the partially complete housing 140 may remain opened so that the interior 216 of the housing is generally accessible. The cradle 170 including the first and second aftertreatment bricks can be inserted into the interior of the housing 140 though either the opened front 212 or rear 214. The cradle 170 may be situated approximately mid-length between the front 212 and rear 214 and welded or otherwise secured in place. In the third step 220, the other internal components of the aftertreatment module such as the diffuser plate 176 can be inserted through the opened front 212 or rear 214 and secured in place. In the fourth step 230, the oval-shaped front plate 142 is attached by welding or the like to the opened front 212 of the housing 140 and the correspondingly shaped rear plate 144 is attached to the opened rear 214 so that housing is substantially closed.

Referring to fifth step 240, tubes 242 and gussets 244 can be secured to the front plate 142 proximate to the first port 172 and the second port 182. In the sixth and final step 250, the inlet flange 136 and the outlet flange 138 can be respectively secured to the tubes 242 to form the finished aftertreatment module 130. One possible advantage of the described manufacturing process is the improved adaptability and interchangeability of the components within the streamlined workflow. For example, cradles 170 including cradles accommodating various different types of aftertreatment bricks such as DOCs, SCRs, etc. can be made separately from the housing 140. Both components can be made available to the assembler at the second step 210. The assembler can select cradles with different aftertreatment bricks having different operational characteristics for insertion into the same style of housing. Thus, the aftertreatment modules can be customized for various applications.

Figure 7:
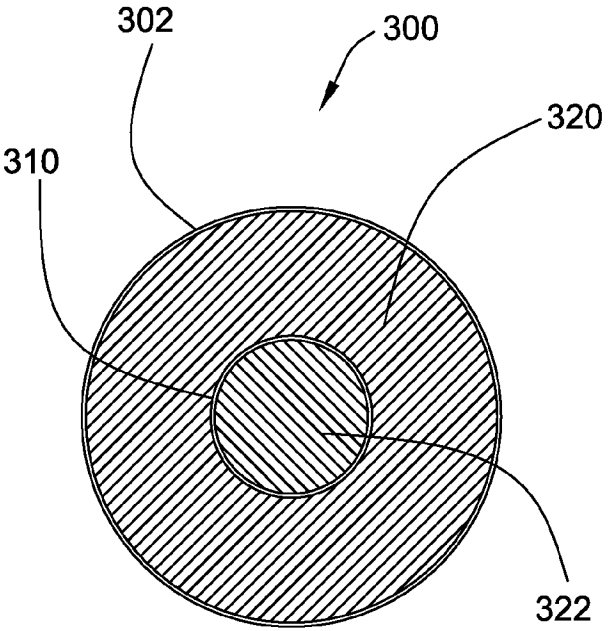
FIG. 7 is a front elevational view of the aftertreatment device of FIG. 6 illustrating the concentric arrangement of the first and second aftertreatment bricks.
Figure 6:
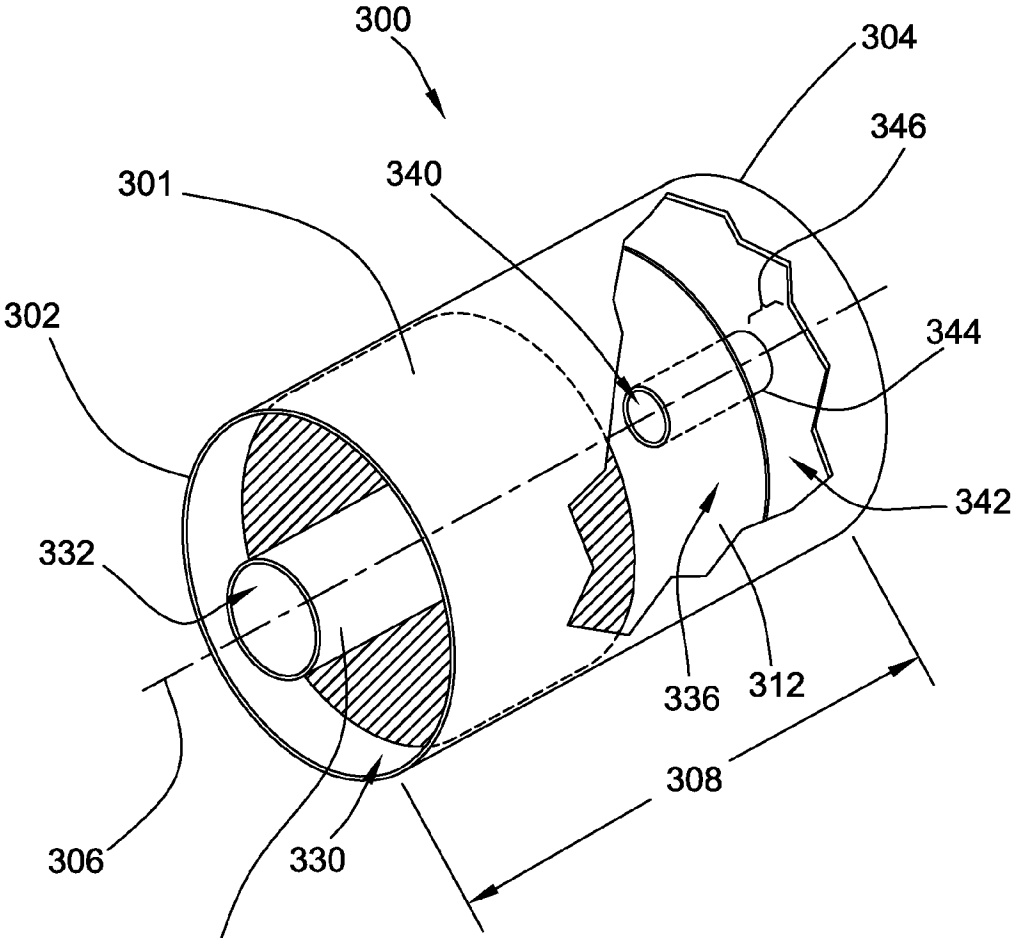
FIG. 6 is a fragmentary perspective view of another embodiment of an aftertreatment module including a cylindrically-shaped housing and illustrating a sound attenuation device disposed in the housing.

Referring to FIGS. 6 and 7, there is illustrated an alternative embodiment of a dual reverse flow aftertreatment module 300 wherein the first and second aftertreatment bricks are arranged in a concentric relationship rather than a side-by-side relationship. The aftertreatment module 300 can include an elongated, cylindrical housing 301 that extends between a front end 302 and a rear end 304 to delineate an axis line 306. The distance between the front end 302 and the rear end 304 defines an axial length 308 of the housing. The front end 302 can be opened and the rear end 304 can be closed. Concentrically disposed within the housing 301 along the axis line 306 can be a cylindrical inner tube 310 or pipe that protrudes from the front end 302 but terminates short of and is spaced apart from the rear end 304. Also disposed inside the housing 302 and axially spaced from the rear end 304 approximately a quarter or a third of the length 308 of the housing 301 can be an internal wall 312. The internal wall 312 can have a circular shape corresponding to the inner diameter of the housing 301 and can be circumferentially secured to the housing by welding or the like.

To reduce the byproducts in the exhaust gasses, the aftertreatment module 300 can include a first aftertreatment brick 320 and a second aftertreatment brick 322 accommodated in the housing 301. The first and second aftertreatment bricks 320, 322 can be any of the aforementioned types including DOCs, SCRs and DPFs. To install the first aftertreatment brick 320 in the housing 301, it can be annular in shape with an outer diameter corresponding to the inside diameter of the housing and an inner diameter corresponding to the outer diameter of the inner pipe 310. The first aftertreatment brick 320 can be axially inserted through the opened front end 302 around the inner pipe 310 and can be axially positioned between the front end and the internal wall 312. To install the second catalyst 322 inside the inner tube 310, the second catalyst can have a solid cylindrical or puck-like shape with a diameter corresponding to the inner diameter of the inner tube. The second catalyst 322 can be inserted between the front end 302 and the internal wall 312 coextensively along the length 308 with the first catalyst 320.

To direct the exhaust gasses through the aftertreatment module 300, the outer housing 301 and the inner tube 310 can define an annular first flow channel 330 and the inner tube can define a circular second flow channel 332. The first and second flow channels 330, 332 can extend parallel to the axis line 306. To establish fluid communication between the first flow channel 330 and the second flow channel 332, the space between the internal wall 312 and the axially spaced apart first and second aftertreatment bricks 320, 322 can delineate a traverse flow channel 336. Gas flow within the traverse channel 336 will be generally normal or perpendicular to the axis line 306. To attenuate sound, a sound attenuation device 340 can include an enclosed sound attenuation chamber 342 disposed between the internal wall 312 and the closed rear end 304. To communicate between the sound attenuation chamber 342 and the traverse channel 336, a sound attenuation pipe 344 can be disposed through the internal wall and axially aligned with respect to the axis line 306. The sound attenuation pipe 344 can terminate and be spaced-apart from the rear end 304 a short distance indicated by bracket 346. In other embodiments, a plurality of sound attenuation tubes can be disposed in the internal wall 312 and arranged generally in a circle around the axis line 306.

INDUSTRIAL APPLICABILITY

The present disclosure is applicable to treating exhaust gasses from a power source by directing the exhaust gasses through a reverse or redirected flow aftertreatment module. Referring to FIG. 1, exhaust gasses including various byproducts produced by an internal combustion engine 102 can be communicated by an exhaust system 116 operatively associated with the engine to an aftertreatment system having an aftertreatment module 130. Referring to FIG. 3, the untreated exhaust gasses can be introduced to the aftertreatment module 130 through the first port 172. The first flow channel 178 can align the exhaust gasses along the first principal flow axis 179 and channel the gasses in the rearward direction. The first flow channel 178 accordingly directs the exhaust gasses from the front wall 142 rearward toward the rear wall 144 through the first aftertreatment brick 160 that can catalyze byproducts by, for example, equations (1) and (2) above. The exhaust gasses may enter the traverse channel 180 from the first aftertreatment brick 160 where they are redirected in the traverse direction along the traverse axis 181. The change in direction between the first principal flow axis 179 and the traverse axis 181 may be approximately 90°.

In an embodiment, the traverse channel can direct the exhaust gasses past the sound attenuation device 190 disposed between the first and second flow channels 178, 188. The exhaust gasses may carry sounds from the internal combustion engine such as the opening or closing of valves or the combustion event explosions in the cylinders. To reduce or muffle these noises, the sound attenuation pipe 194 communicating with the traverse channel 180 can receive at least some portion of the sound waves responsible for the noises and can channel them to the sound attenuation chamber 192. In specific embodiments, the dimensions such as the length and diameter of the sound attenuation pipe 194 can be tuned to cancel specific frequencies of sounds from the engine. For example, the sound attenuation pipe 194 can be designed to acoustically resonate with certain frequencies while canceling others such that the resulting sound emitted from the aftertreatment module is reduced or better tuned for further reduction in the muffler. Additionally, the sound attenuation pipe can be tuned by adjusting its dimensions to cancel loud or high pitched sounds such as when the engine is accelerating. For example, the sound attenuation chamber can be tuned to target specific frequencies within the range of human hearing, for example, to minimize the effect of undesirable sounds. In other embodiments, the sound attenuation pipe can be tuned to specific sizes of engines or certain numbers of cylinders.

To direct the exhaust gasses through the second aftertreatment brick 162, the intersection of the traverse channel 180 and the second flow channel 188 can redirect the exhaust gasses 90° to align them with the second principal flow axis 189. The second flow channel 188 directs the exhaust gasses from the traverse channel 180 forward through the second aftertreatment brick 162 toward the front wall 142. The treated exhaust gasses can be discharged from the aftertreatment module 130 through the second port 182. The first principal flow axis 179, the traverse flow axis 181, and the second principal flow axis 189 redirect the exhaust gasses approximately 180° such that the exhaust gas flow is redirected by the first flow channel 178, the traverse flow channel 180, and the second flow channel 188. Although the illustrated embodiment describes the exhaust gasses flowing from the first port to the second port, it should be appreciated that in other embodiments the direction of flow can be reversed, i.e., from the second port to the first port. The aftertreatment module can thus be a reversible module simplifying its installation.

Referring to FIGS. 6 and 7, the embodiment of the aftertreatment module 300 therein can also redirect the flow the exhaust gasses. Specifically, the exhaust gasses can circumferentially enter the annular first flow channel 330 which directs the gasses rearward through the first aftertreatment brick 320 to the traverse flow channel 336 that redirects the gasses 180° to align with the second flow channel 332 delineated by the inner tube 310. The second flow channel thereby directs the exhaust gasses through the second aftertreatment brick 322. When the exhaust gas flow is redirected in the traverse flow channel 336, the sound carried by the exhaust gasses may be attenuated by the attenuation device 340 in the above described manner.

Accordingly, the disclosed aftertreatment module directs exhaust gasses through both a first aftertreatment brick and a second aftertreatment brick by redirecting or reversing the flow of the exhaust gasses 180°. One advantage of the disclosure is that the reversal of flow and arrangement of the first and second aftertreatment bricks side-by-side permits considerable space reduction and results in a more compact and efficient aftertreatment module. The compact design also allows the aftertreatment module to be contoured or streamlined to have an aerodynamic shape. These advantages facilitate use of the aftertreatment module in mobile applications such as the power system of FIG. 1 where the module may be located at an exposed location on the mobile trailer. In certain embodiments, the disclosed aftertreatment module may also reduce sound carried by the exhaust gasses by a sound attenuation device incorporated therein.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An aftertreatment module for treating exhaust gasses from a high-powered internal combustion process, the aftertreatment module comprising:

a low-profile housing including a planar, plate-like front wall and a correspondingly-shaped rear wall spaced apart from the front wall, a flat top surface, and correspondingly-shaped flat bottom surface spaced apart from the top surface to provide the low-profile;

a first port and a second port disposed through the plate-like front wall;

a first aftertreatment brick disposed between the front wall and the rear wall and aligned with the first port;

a second aftertreatment brick disposed between the front wall and the rear wall and aligned with the second port;

the first aftertreatment brick and the second aftertreatment brick each having a flow-through configuration and arranged in a side-by-side arrangement;

wherein arrangement of the low-profile housing and the enclosed first and second aftertreatment bricks defines an entry region and an exit region between the front wall and the first and second aftertreatment bricks, respectively, and a traverse channel between the rear wall and the first and second aftertreatment bricks; and a sound attenuation pipe communicating with a sound attenuation chamber that is disposed between the first and second aftertreatment bricks;

wherein arrangement of the low-profile housing and the enclosed first and second aftertreatment bricks further defines a first principle flow axis from the first port through the entry region and the first aftertreatment brick toward the rear wall; a second principle flow axis from proximate the rear wall through the second aftertreatment brick and the exit region to the second port, and a traverse flow axis extending perpendicularly between the parallel first and second principle flow axes, the sound attenuation chamber separately enclosed from and disposed between the first and second principle flow axes, the sound attenuation chamber communicating only with the traverse flow axis through the sound attenuation pipe.

2. The aftertreatment module of claim 1, wherein the front wall and the rear wall are oval-shaped, and the first port and the second port are oriented toward curved edges of the oval-shaped front wall.

3. The aftertreatment module of claim 2, wherein the top surface and the bottom surface extend between upper lateral edges and lower lateral edges, respectively, of the oval-shaped front and rear walls.

4. The aftertreatment module of claim 3, wherein the housing further includes an arcuate-shaped first sidewall extending between curved edges of the oval-shaped front wall and the correspondingly-shaped rear wall; and an arcuate-shaped second sidewall extending between curved edges of the oval-shaped front wall and the correspondingly-shaped rear wall.

5. The aftertreatment module of claim 4, wherein the first aftertreatment brick and the second aftertreatment brick are cylindrical in shape and the first aftertreatment brick is adjacent the first arcuate sidewall and the second aftertreatment brick is adjacent the second arcuate sidewall.

6. The aftertreatment module of claim 1, further comprising a cradle enclosed in the housing mid-way between the front wall and the rear wall, the cradle accommodating both the first and second aftertreatment bricks.

7. The aftertreatment module of claim 6, wherein the first aftertreatment brick and the second aftertreatment brick are cylindrical in shape and the cradle includes a first cylindrical sleeve and a second cylindrical sleeve for accommodating the first and second aftertreatment bricks respectively.

8. The aftertreatment module of claim 7, wherein the first aftertreatment brick and the second aftertreatment brick are accommodated in a side-by-side relation coextensively mid-way between the front wall and the rear wall of the housing.

9. The aftertreatment module of claim 1, wherein the first aftertreatment brick and the second aftertreatment brick are cylindrical in shape and include an open-lattice matrix supported inside of a cylindrical mantel.

10. The aftertreatment module of claim 9, wherein the first aftertreatment brick and the second aftertreatment brick are diesel oxidation catalysts.

11. The aftertreatment module of claim 1, wherein the first principal flow axis, the traverse flow axis, and the second principal flow axis redirect the exhaust gasses substantially 180° from the first port to the second port.

12. The aftertreatment module of claim 1, wherein the aftertreatment module is configured for treating exhaust gasses from internal combustion engines sized to produce power on the order of 750 horsepower or greater.

13. The aftertreatment module of claim 1, wherein the sound attenuation pipe protrudes into the sound attenuation chamber.

14. A method of assembling an aftertreatment module for treating exhaust gasses comprising:

providing a cradle including a first sleeve and a second sleeve disposed in a side-by-side relationship;

inserting a first aftertreatment brick in the first sleeve and a second aftertreatment brick in the second sleeve;

disposing a sound attenuation pipe between the first sleeve and the second sleeve, the sound attenuation pipe communicating with a sound attenuation chamber;

providing a module housing including an interior region accessible by a front opening and a rear opening;

inserting the cradle through one of the front opening and the rear opening, wherein the sound attenuation chamber is separately enclosed with respect to the interior region except by communication through the sound attenuation pipe;

enclosing the front opening with a front plate having disposed therein a first port and a second port;

and enclosing the rear opening with a rear plate, the rear plate lacking any ports.

15. The method of claim 14, wherein the front plate is oval-shaped, the rear plate is oval-shaped, and the module housing includes a substantially flat top surface, a substantially flat bottom surface, an arcuate first sidewall curving between the top surface and the bottom surface, and an arcuate second sidewall curving between the top surface and the bottom surface.

* * * * *